US006364270B1

(12) United States Patent
Kamei

(10) Patent No.: US 6,364,270 B1
(45) Date of Patent: Apr. 2, 2002

(54) BEAM SUPPORTER

(75) Inventor: Susumu Kamei, Oita (JP)

(73) Assignee: Shinko Corporation, Osaka (JP)

( * ) Notice: Subject to any disclaimer, the term of this patent is extended or adjusted under 35 U.S.C. 154(b) by 0 days.

(21) Appl. No.: 09/409,812

(22) Filed: Sep. 30, 1999

(30) Foreign Application Priority Data

Oct. 7, 1998 (JP) ..... 10-284931
Dec. 22, 1998 (JP) ..... 10-363986

(51) Int. Cl.[7] ..... A47F 5/00

(52) U.S. Cl. ..... 248/354.1; 248/354.3; 248/351

(58) Field of Search ..... 248/354.1, 354.3, 248/200.1, 351, 352, 405, 422, 354.7, 357, 404; 52/127.2, 127.5, 632

(56) References Cited

U.S. PATENT DOCUMENTS 1,719,528 A * 7/1929 Beckley et al. ..... 248/357
2,762,599 A * 9/1956 Faris ..... 254/100
6,131,870 A * 10/2000 Tseng ..... 248/406.1

* cited by examiner

*Primary Examiner*—Anita King
*Assistant Examiner*—Holly N. Sy
(74) *Attorney, Agent, or Firm*—Jordan and Hamburg LLP

(57) ABSTRACT

A beam supporter has an upper outer cylinder, a lower outer cylinder, a gearbox connecting these cylinders up an down to each other, and a drive and driven bevels mating one another within the gearbox. A sleeve built in the gear box has an outer periphery integral with the driven bevel, a female threaded inner periphery, and a threaded rod is in mesh with the female thread and extends through the inner periphery. A horizontal shaft of the of the drive bevel protrudes from the gearbox to provide an operable protrusion. A sliding inner cylinder is secured to the rod up and down, so that an upper end of this cylinder slidably protrudes from an upper opening of the upper cylinder. A ring-shaped bearing may be disposed around the threaded rod and vertically slidable above the gearbox. A cap is attached to the threaded rod, so that guide sticks depending through the cap hold the bearing freely slidable up and down but always on or above the feet of the guide sticks. Upper ends of the guide sticks have a stopper above an upper face of the cap so that the sticks are prevented from dropping off the cap.

6 Claims, 12 Drawing Sheets

BEAM SUPPORTER

BACKGROUND OF THE INVENTION

1. Field of the Invention

The present invention relates to a pole-shaped beam supporter for use in construction works to build ferro-concrete houses or steel-frame buildings, wherein the supporter will temporarily hold in position the steel frame of an upper floor, any horizontal beam forming a temporary skeleton, a concrete mold or the like for the upper floor.

2. Prior Art

Such beam supporters have usually been set up on an already formed lower floor in order to support the upper floor skeleton or support the horizontal beam of the concrete mold for the upper floor, until subsequent removal upon finishing the latter.

The prior art beam supporters have each at an upper end thereof a single screw jack, or have each at both the upper and lower ends respective screw jacks. These jacks will be operated at their drives to extend or contract the supporters when the latter are fixed in position or removed from between the floors. Each drive is however forced to spin about the supporter's vertical axis, as a handle protruding radially and sideways from the drive is rotated with both the hands of a worker. Operation of such beam supporters have necessitated two persons, one of them just holding the supporter upright while the other driving its screw jack or jacks, thus bringing about a noticeable inefficiency in construction works.

SUMMARY OF THE INVENTION

A primary object of the present invention made in view of this draw-back is therefore to provide a beam supporter of such a compact structure that even a single worker can hold it in place with his one hand, while operating with his other hand a drive portion of said supporter that is being extended or contracted.

A secondary object is to provide a beam supporter comprising an outer cylindrical member, a threaded rod installed therein and a gear box engaging with and driving the threaded rod, and constructed such that said rod is protected well from bending sideways between its upper end and the gear box even when the supporter extends to a maximum limit.

In order to achieve the primary object, the beam supporter provided herein will comprise an upper outer cylinder, a lower outer cylinder extending coaxially therewith, a gearbox fixedly connecting the upper cylinder to the lower cylinder, a drive bevel gear formed as a part of the gearbox and having a horizontal shaft, a driven bevel gear installed in the gearbox, engaging the drive bevel gear and having a vertical shaft, and a sleeve built in the gearbox and in parallel with the cylinders. The sleeve has an outer periphery whose intermediate portion is integral with the driven bevel gear, and the sleeve further has an inner periphery with a female thread formed thereon to extend from top to bottom of the inner periphery. The beam supporter further comprises a threaded rod in mesh with the female thread and penetrating the gearbox. The horizontal shaft of the drive bevel gear extends sideways and outwardly from the gearbox so as to provide a protrusion operable to rotate the drive bevel gear. The beam supporter still further comprises a sliding inner cylinder having a lower end secured to an upper end of the threaded rod, so that an upper end of the inner cylinder slidably protrudes a variable distance upwards from an upper opening of the upper outer cylinder when a handle or the like is used to operate the gearbox.

Preferably, the sliding inner cylinder may be inhibited from rotating relative to the upper outer cylinder. To assure that the inner cylinder does slide only in a longitudinal direction, at least one vertical groove (or more preferably, two parallel grooves) may be formed in the inner periphery of the upper outer cylinder. In such a case, a transverse pin will fix the sliding inner cylinder to the threaded rod, and this pin will have opposite ends protruding transversely and kept in a sliding engagement with the vertical grooves.

The upper end of the upper outer cylinder may have a stopper for stopping the transverse pin at its highest position, thereby protecting the sliding inner cylinder from slipping off said outer cylinder.

Freely rotatable rollers attached to the opposite ends of the pin will reduce friction so as to assist those ends to smoothly slide in and along the vertical grooves.

In order to achieve the secondary object, a ring-shaped annular plain bearing is disposed around the threaded rod and capable of vertically sliding above the gearbox. Guide sticks each of a predetermined length and depending through a cap that is secured to the upper end of the threaded rod may hold the ring-shaped bearing. The bearing is allowed to freely slide up and down, but always resting on lower stopping means that are disposed at feet of the guide sticks. Upper ends of the guide sticks comprise a stopper disposed on (and usually above) the upper face of the cap, so that those sticks are prevented from dropping off the cap.

It is preferable also in this case that the sliding inner cylinder will not rotate relative to the upper outer cylinder but merely slide therein. For this purpose, these two cylinders may respectively have longitudinal lugs and grooves engage with each other.

THE PREFERRED EMBODIMENTS

Figure 1:
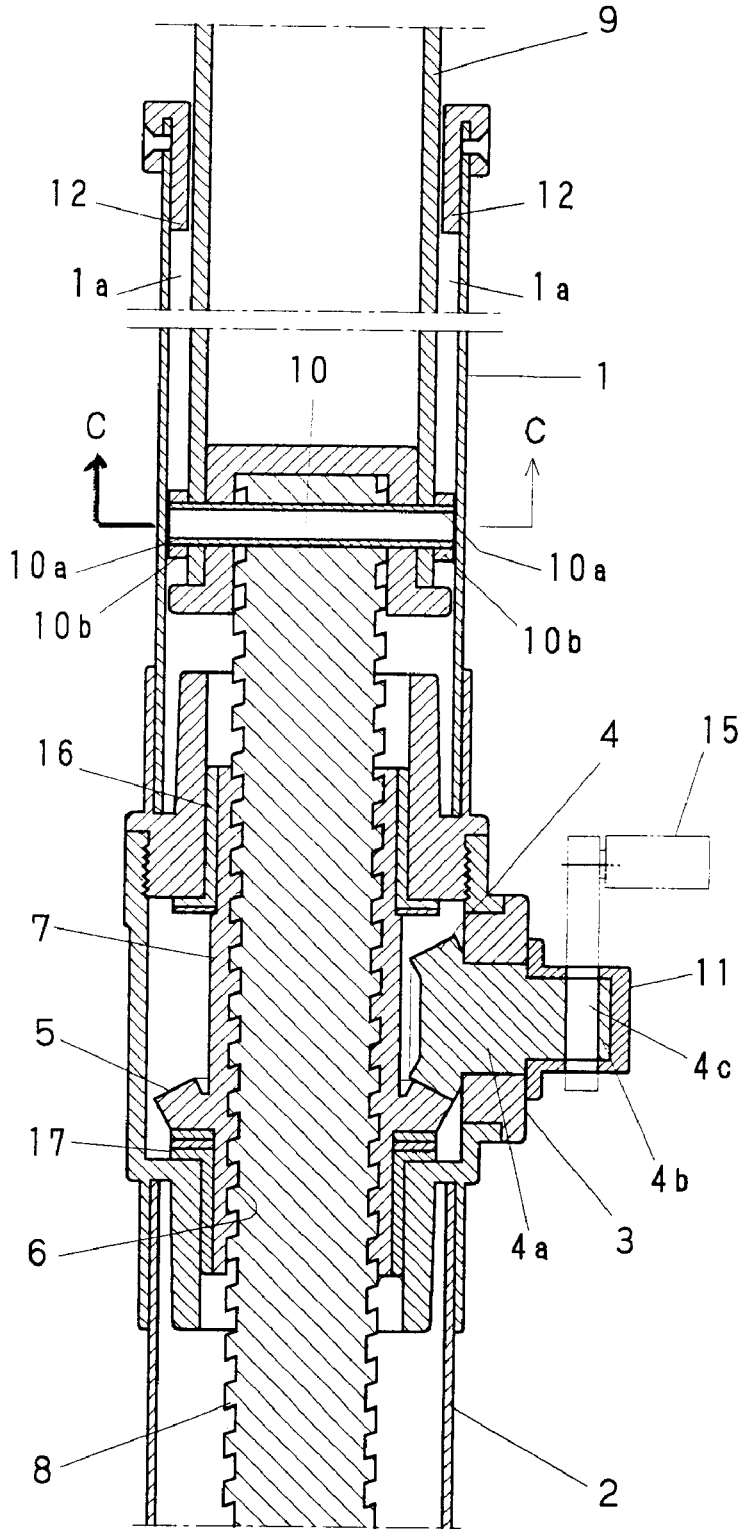
FIG. 1 is a vertical cross section of the principal part of a beam supporter provided in a first embodiment of the present invention.
Figure 2:
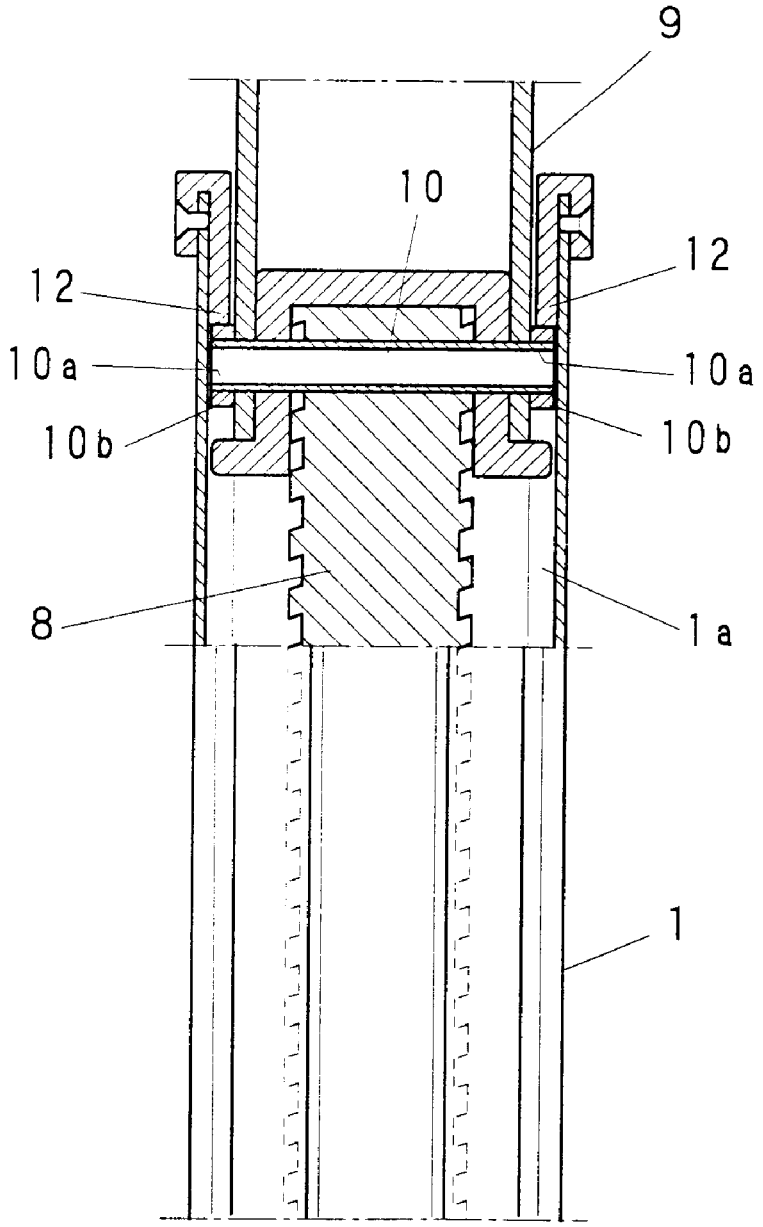
FIG. 2 is a front elevation of the beam supporter shown partly in cross section, with a sliding inner cylinder thereof taking its uppermost position.
Figure 3:
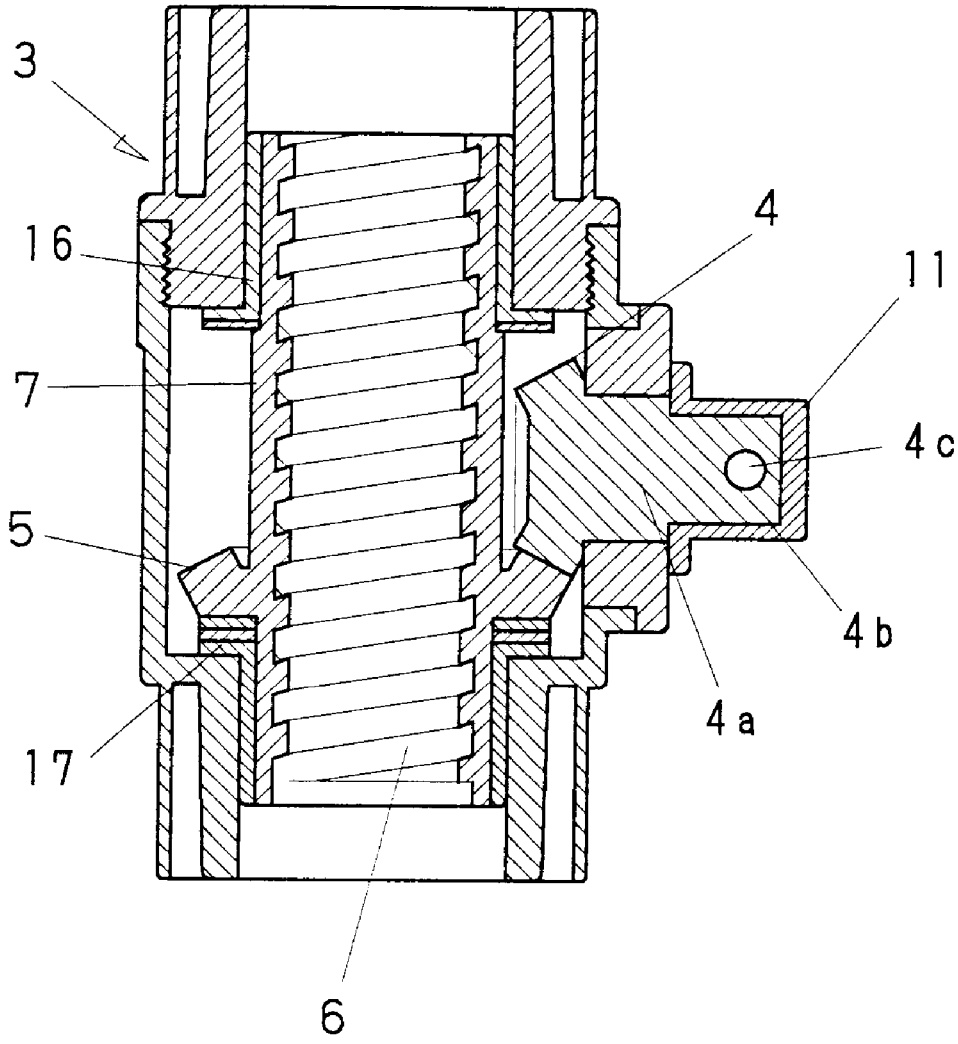
FIG. 3 is a vertical cross section of a gearbox included in the beam supporter.
Figure 4:
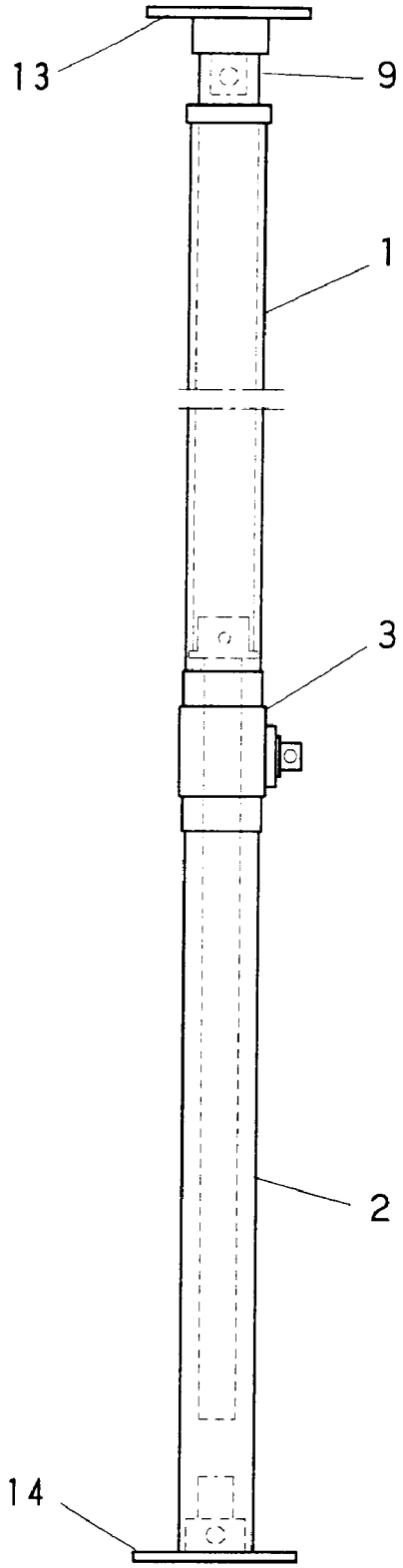
FIG. 4 is a front elevation of the beam supporter shown in its entirety but partly in cross section, with the sliding inner cylinder taking its lower-most position.

Some preferable embodiments of the present invention will now be described referring to the drawings.

FIRST EMBODIMENT

FIGS. 1 to 6 show a beam supporter provided in accordance with a first embodiment of the present invention. The reference numeral 3 denotes a gearbox that connects an upper outer cylinder 1 to a lower outer cylinder 2, so that those cylinders disposed above and below the gearbox are thus made integral and coaxial with each other.

Installed in the gearbox 3 are a drive bevel gear 4 having a horizontal shaft and as well as a driven bevel gear 5 having a vertical shaft and always kept in mesh with the drive bevel gear. A sleeve 7 having a threaded inner periphery 6 has an outer periphery on which the driven bevel wheel is formed integral therewith. Thus, the sleeve serves as the vertical shaft of the driven bevel gear. A vertical hole defined with the inner periphery extends from top to bottom of said sleeve so as to receive and engage with an elongate threaded rod 8. The horizontal shaft 4*a* of the drive bevel gear 4 protrudes outwards from the gearbox 3, thereby providing an operable protrusion 4*b* rotatable around a horizontal axis of the drive bevel gear. A handle 15 may detachably be attached to the operable protrusion 4*b* in order to cause the threaded rod 8 to ascend or descend. In the illustrated example, a distal end of the handle will fit in an aperture 4*c* formed transversely through the protrusion 4*b*. Instead of such an aperture, the protrusion of the shaft 4*a* may be of a square or any irregular shape other than a round shape in cross section, or alternatively an end face of the shaft may have a recess also removably mating with the handle.

A sliding inner cylinder 9 is secured to a top of the threaded rod 8 in such a state that an upper portion of the inner cylinder does slidably protrude from an upper opening of the upper outer cylinder 1. An upper end of the sliding cylinder 9 is fixed to a top plate 13 on one hand, and a lower end of the lower outer cylinder 2 is fixed on a base plate 14, whereby this beam supporter can bear a load in a stable manner.

An inner periphery of the upper outer cylinder 1 is of such a profiled cross section that two or more longitudinal grooves 1*a* present therein are symmetrical with each other. Opposite protruding ends 10*a* of a transverse pin 10 connecting the sliding cylinder 9 to the threaded rod 8 slidably fit in two of the grooves 1*a* located diametrically. This structure will inhibit the sliding cylinder 9 from rotating relative to the outer cylinder 1 and will force the former to move only in a longitudinal direction in and along the latter. Freely rotatable small rollers 10*b* that may be attached to the pin's opposite ends will reduce friction thereof in the grooves la and thus facilitate the sliding displacement of the inner cylinder 9.

A stopper 12 secured to the upper end of the upper outer cylinder 1 will stop the pin's protruding opposite ends 10*a* or the small rollers 10*b* at a upper limit of the sliding motion. In other words, the sliding cylinder 9 is prevented from ascending beyond the upper limit and slipping off the outer cylinder 1.

In order to render the beam supporter lighter in weight as a whole, any of appropriate light metals such as aluminum alloys may be employed to form some parts and members such as the gearbox 3, bevel gears 4 and 5 accommodated therein, the sleeve 7 and the threaded rod 8. In this case, an outer surface of the operable protrusion 4*b* jutting from the gearbox 3 will preferably be covered with a cover 11 made of a harder metal such as iron. The reference numerals 16 and 17 denote collars and slip rings, respectively.

Figure 5:
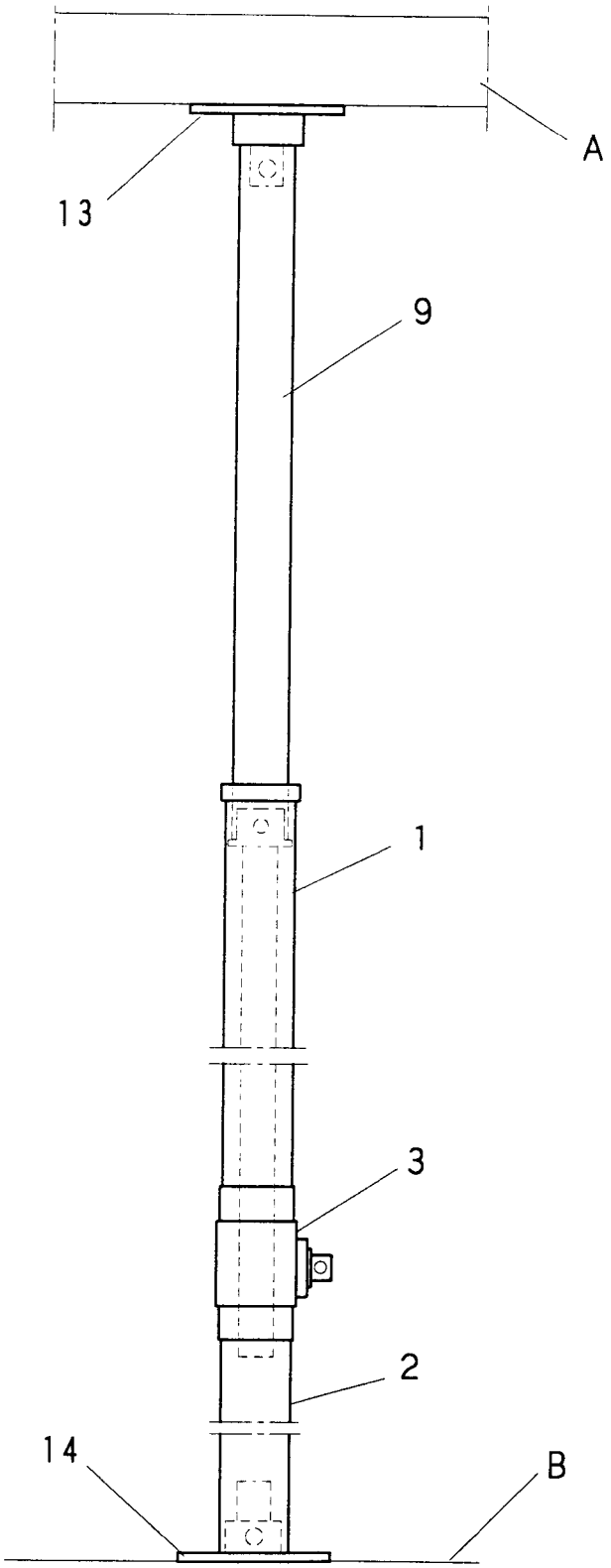
FIG. 5 is also a front elevation similar to FIG. 4 but showing the sliding inner cylinder at its uppermost position.
Figure 6:
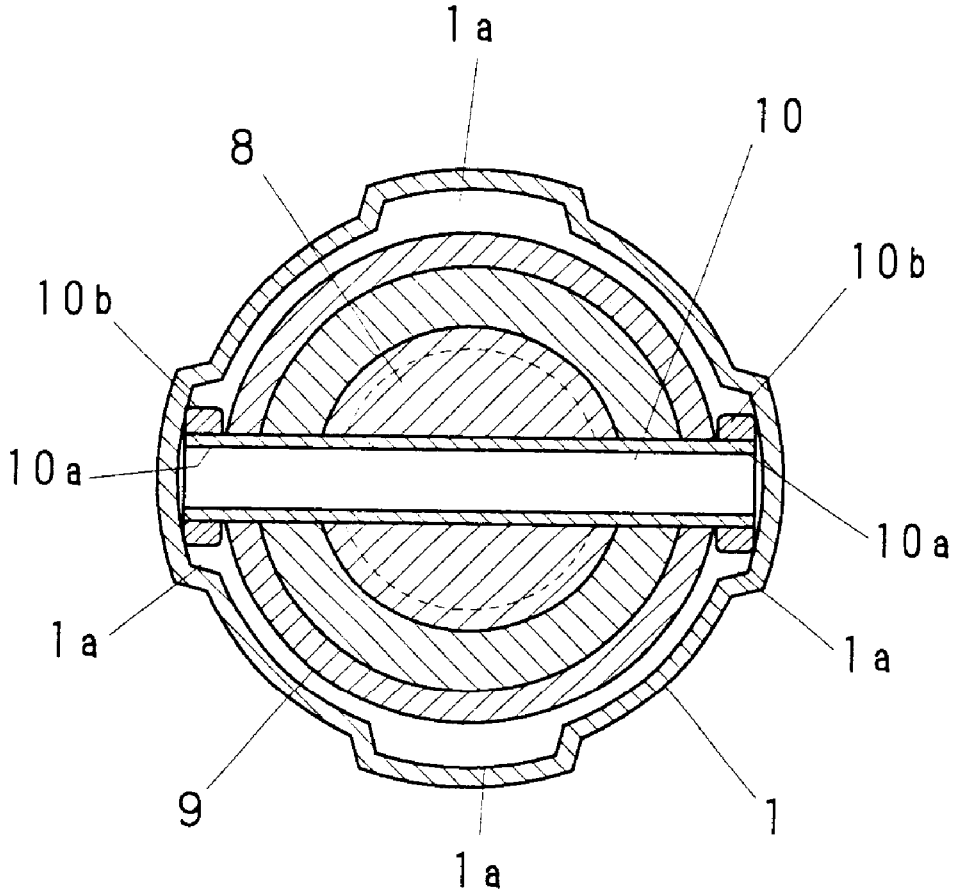
FIG. 6 is a cross section taken along the line C—C in FIG. 1.

The beam supporter of the described structure may be used in a manner as illustrated in FIG. 5. This supporter in its extended state stands on a finished lower floor 'B' so as to support a beam or the like 'A' used to form an upper floor. This beam may be a portion of an iron skeleton, a temporary frame of the upper floor, or a horizontal square bar of a concrete mold. A single worker can hold the supporter upright with his or her one hand while he or she is turning the handle 15 with his or her other hand so as to drive the threaded rod 8 to raise or lower the sliding inner cylinder 9. Engagement of the drive bevel 4 with the driven bevel 5 enables that a smaller torque for rotating the drive bevel suffices well to impart a stronger thrust to the threaded rod 8 being raised or lowered, whereby the worker can now easily and reliably set the beam supporter at any desired location.

SECOND EMBODIMENT

In a second embodiment shown in FIGS. 7 to 12, a cap 20 intervenes between the top of threaded rod 8 and the sliding inner cylinder 9 connected thereto.

The stopper 12 secured to the top of the upper outer cylinder 1 will in this case abut against a flange 20*a* of the cap 20, also preventing the inner cylinder 9 from rising beyond an upper limit and slipping off the outer cylinder 1.

A ring-shaped annular plain bearing 26 is disposed around the threaded rod 8 and capable of vertically sliding above the gearbox 3. Guide sticks 27 each of a predetermined length and depending through apertures 20*b* of the cap 20 secured to the upper end of the threaded rod 8 may hold the ring-shaped bearing 26. This bearing 26 is allowed to freely slide up and down, but always resting on nuts 28 serving as the lower stopping means disposed at downwardly protruding or exposed feet of the guide sticks 27 inserted in and through respective apertures 26*a*. Upper ends of those guide sticks inserted upwards and slidable up and down through the apertures 20*b* do comprise a common stopper 27*a* that is formed integral with the sticks and disposed on (and usually above) the upper face of the cap 20, lest those sticks 27 should drop off the cap.

Figure 7:
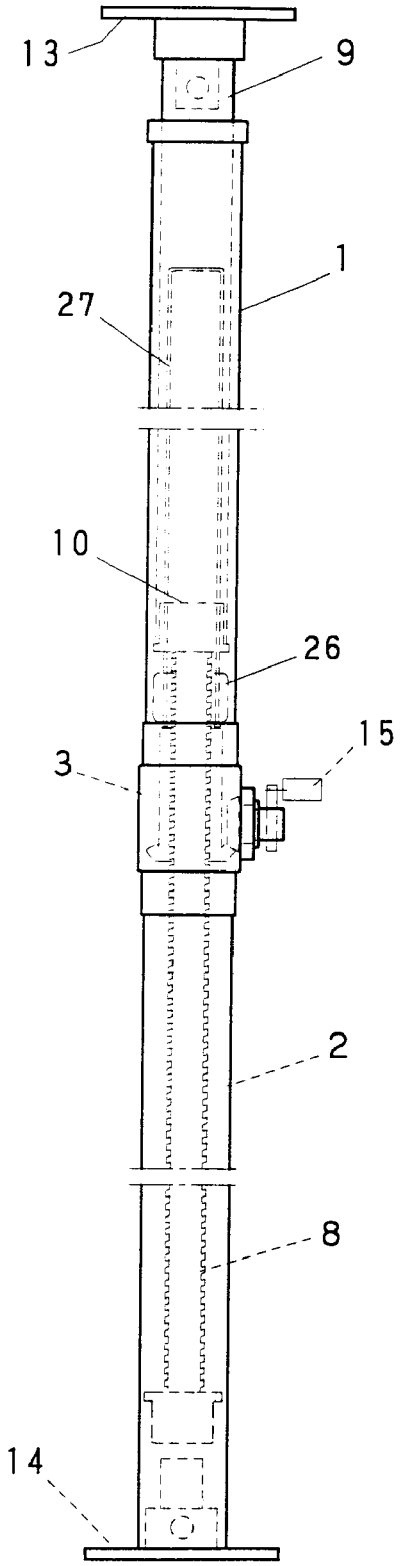
FIG. 7 is a front elevation of a beam supporter provided in a second embodiment and shown in its entirety, with its sliding inner cylinder taking a lowermost position.
Figure 8:
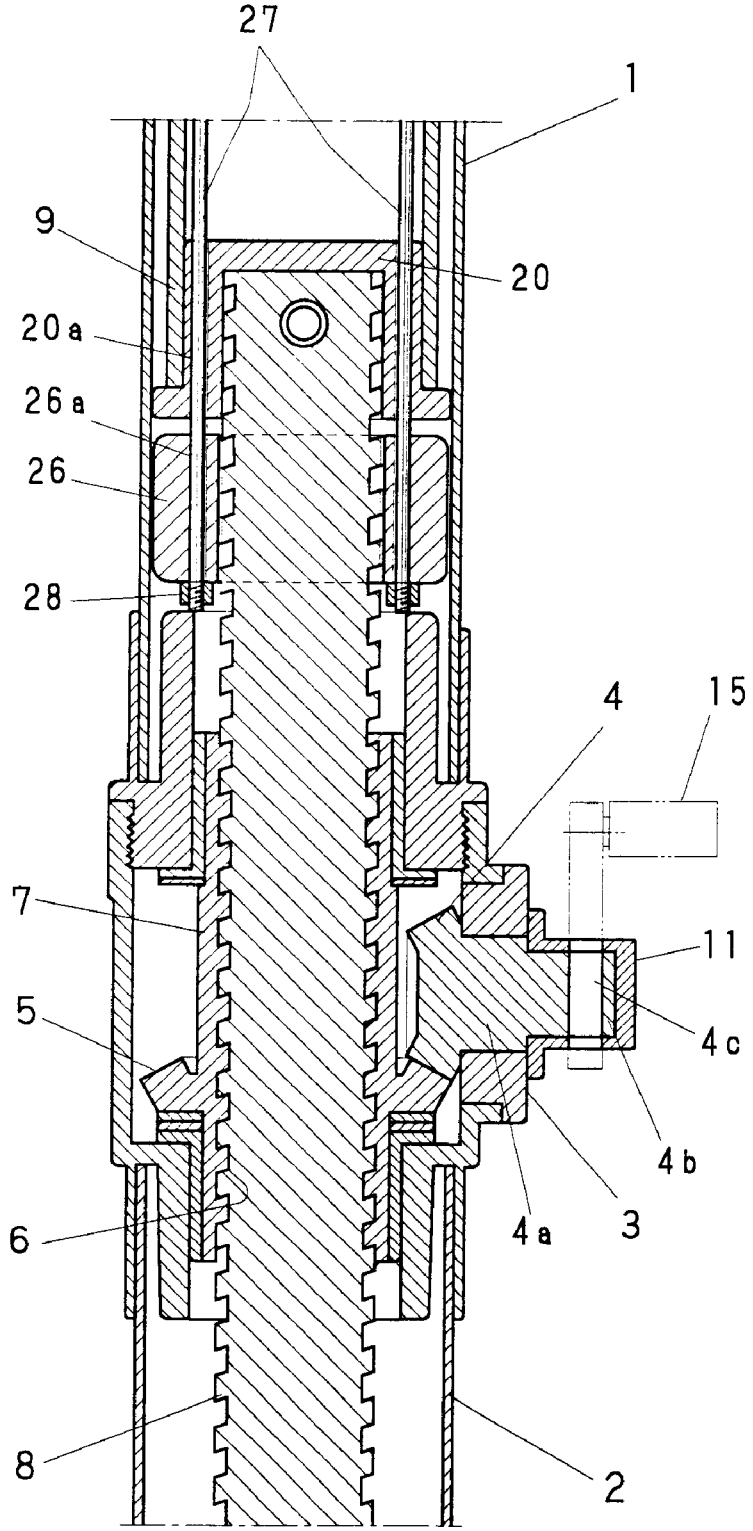
FIG. 8 is an enlarged vertical cross section of a principal part of the beam supporter shown in FIG. 7.
Figure 9:
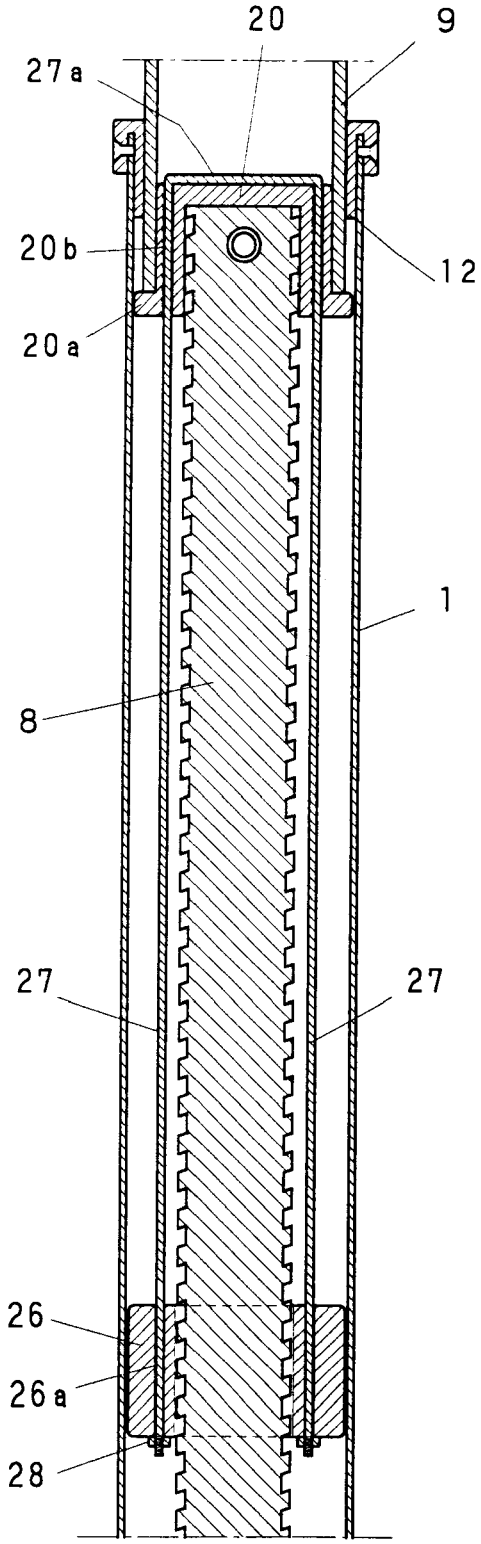
FIG. 9 also is an enlarged vertical cross section of the principal part, with its sliding inner cylinder taking an uppermost position.
Figure 10:
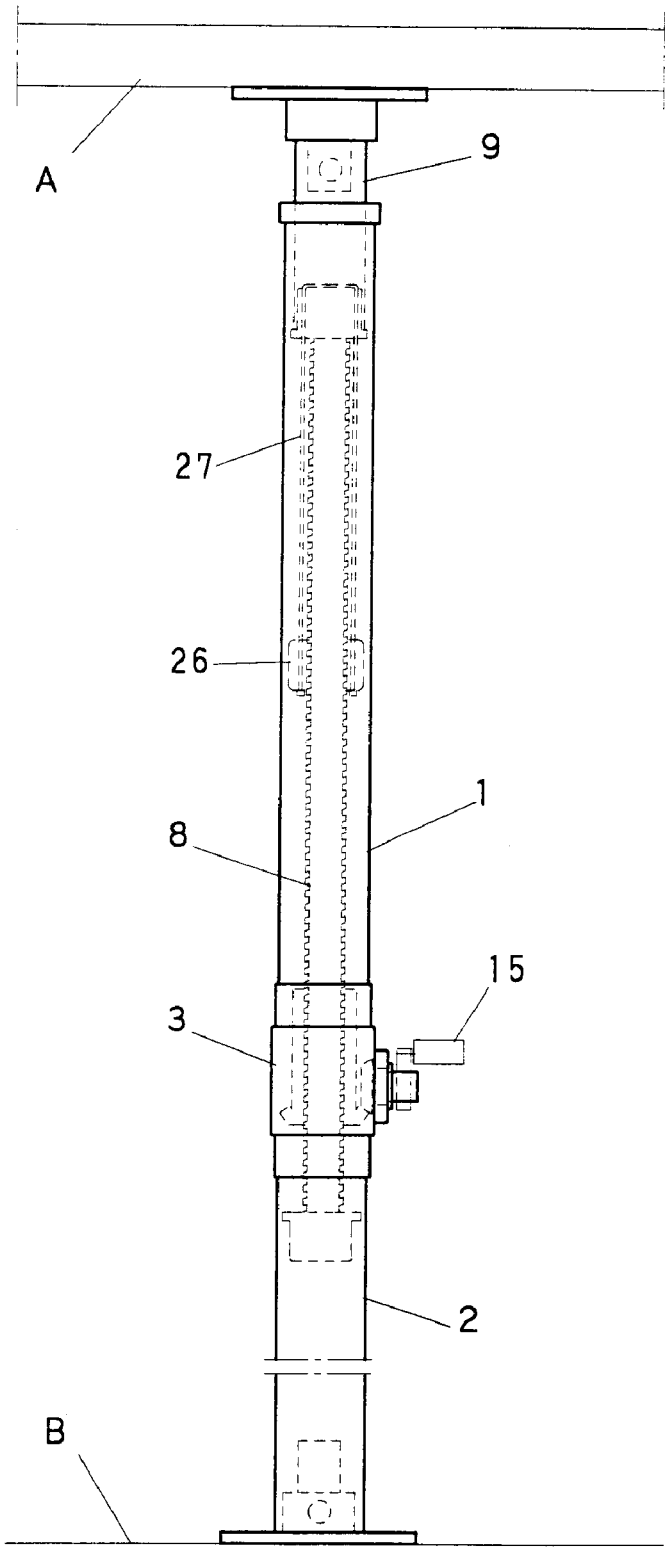
FIG. 10 is a front elevation of the beam supporter of the second embodiment shown in its entirety, with its sliding inner cylinder taking the uppermost position.
Figure 11:
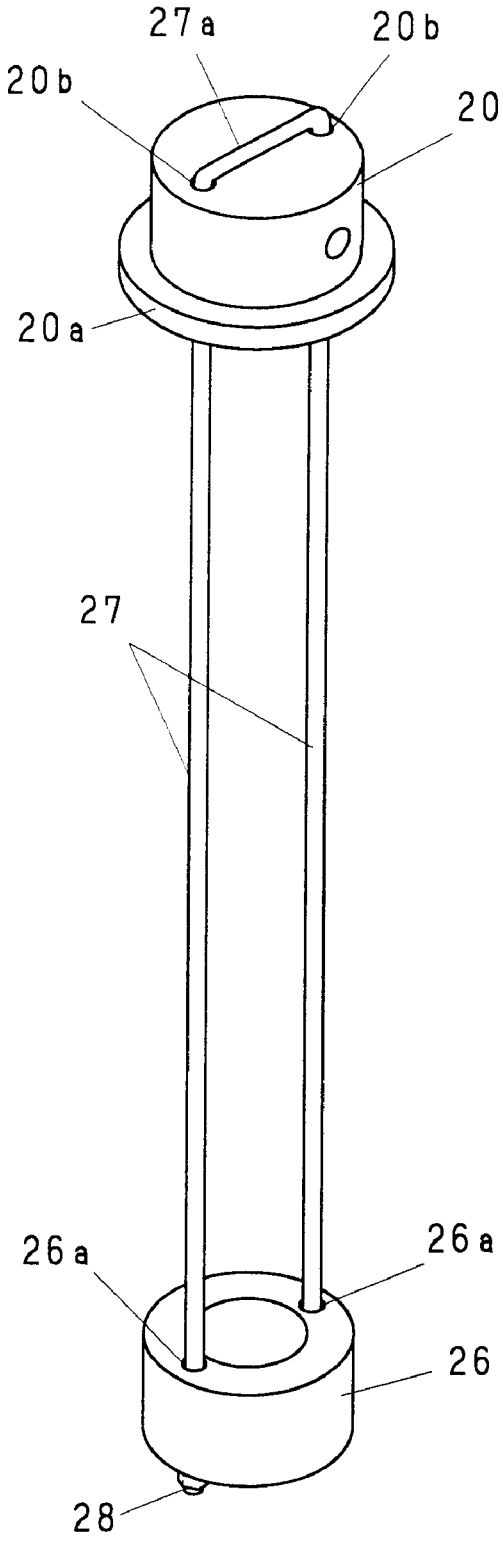
FIG. 11 is a perspective view of a ring-shaped bearing and relevant parts included in the second embodiment.

FIGS. 7 and 8 show the sliding cylinder 9 fully lowered together with the threaded rod 8. At such a lowermost position, the guide sticks 27 have their feet resting on an upper face of the gearbox 3, with the ring-shaped annular plain bearing 26 also taking their lowest position adjacent to said feet of the sticks. If the handle 15 is turned to raise the sliding cylinder 9 connected to the threaded rod 8, then the beam supporter will be forced to stretch itself between the lower floor 'B' and the upper floor's beam or the like 'A' so as to support the latter on the former. As will be seen in FIG. 9, such an ascending rod 8 will in turn cause lower portions of the guide sticks 27 to lift the ring-shaped bearing 26. As a result, the threaded rod's free intermediate portion located between the cap 20 and the gearbox 3 will be born in position within the upper outer cylinder 1. A distance thus reduced between the rod's adjacent born positions will reinforce said rod in axial direction. The predetermined length of each guide stick 27 may desirably be such that the ring-shaped bearing 26 will be placed exactly at the middle point between the cap 20 and the gearbox 3 when the rod 8 takes its highest position.

Figure 12:
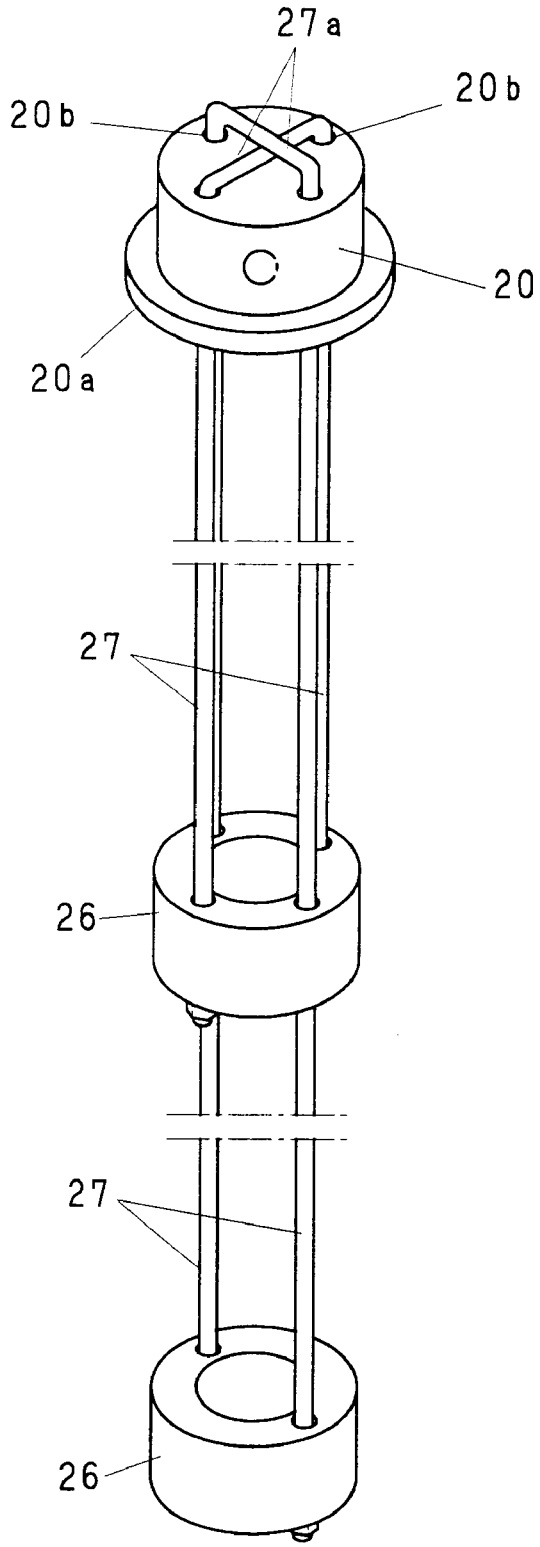
FIG. 12 is a perspective view of a modified ring-shaped bearing and relevant parts also included in the second embodiment.

The ring-shaped bearing 26 discussed above may be modified in a fashion as shown in FIG. 12. According to this modification, one pair of shorter guide sticks 27 are combined with another pair of longer one 27 in the illustrated manner. The distance spanning the two adjacent bearing points for the threaded rod 8 will be rendered still smaller, to thereby further improve the axial tenacity thereof.

As it will now be apparent, the second embodiment detailed above is advantageous in that the ring-shaped bearing engaging with the lower portions of the guide sticks will follow these sticks rising simultaneously with the threaded rod in such a manner that at least one intermediate bearing point is added to those present in the first embodiment. Consequently, the rod will automatically be protected from bending sideways when the beam supporter is stretched in use.

The two embodiments are discussed above only by way of examples, to which the present invention is not delimited. There may be many modifications such as one in which only one of the opposite ends of the transverse pin 10 protrudes outwardly from the sliding cylinder 9 and fits in one inner longitudinal groove 1*a* of the upper outer cylinder 1. This is because such fashions of modification would not depart from the spirit and scope of the present invention.

In summary, the beam supporter provided herein can now be set up by only one worker so that beams will be assembled or disassembled more efficiently, although a slight torque need be imparted to the gear train composed of drive and driven bevels when forcibly setting up the beam supporter to take its stable position.

What is claimed is:

1. A beam supporter comprising:

an upper outer cylinder, a lower outer cylinder extending coaxially with the upper outer cylinder, a gearbox fixedly connecting the upper outer cylinder to the lower outer cylinder, a drive bevel gear formed as a part of the gearbox and having a horizontal shaft, a driven bevel gear installed in the gearbox, engaging the drive bevel gear and having a vertical shaft, a sleeve built in the gearbox and in parallel with the upper and lower cylinders, the sleeve having an outer periphery whose intermediate portion is integral with the driven bevel gear, the sleeve further having an inner periphery with a female thread formed thereon to extend from top to bottom of the inner periphery, a threaded rod in mesh with the female thread and penetrating the gearbox through the inner periphery thereof, the horizontal shaft of the drive bevel gear extending sideways and outwardly from the gearbox so as to provide a protrusion operable to rotate the drive bevel gear, and a sliding inner cylinder having a lower end secured to an upper end of the threaded rod, so that an upper end of the sliding inner cylinder slidably protrudes a variable distance upwards from an upper opening of the upper outer cylinder in response to movement of an operating means.

2. A beam supporter as defined in claim 1, further comprising at least one vertical groove formed in the inner periphery of the upper outer cylinder, and a transverse pin fixing the sliding inner cylinder to the threaded rod, wherein the transverse pin has at least one end protruding transversely and exposed so as to be kept in a sliding engagement with the vertical groove, whereby the sliding inner cylinder is inhibited from rotating relative to the upper outer cylinder of a non-round cross section.

3. A beam supporter as defined in claim 2, wherein an upper end of the upper outer cylinder has a stopper for stopping the end of the transverse pin at a highest position of the transverse pin, thereby protecting the sliding inner cylinder from slipping off the upper outer cylinder.

4. A beam supporter as defined in claim 3, wherein a freely rotatable roller is attached to the exposed end of the transverse pin.

5. A beam supporter as defined in claim 1, 2 or 3, wherein the gearbox and the driven bevel gear are made of a light metal, and the protrusion is enclosed with a cover of another metal harder than the light metal.

6. A beam supporter as defined in any one of the claims 1–4, wherein a top plate is secured to the upper end of the sliding inner cylinder, and a base plate is secured to a lower end of the lower outer cylinder.

* * * * *